US006726047B2

(12) United States Patent
Lin

(10) Patent No.: US 6,726,047 B2
(45) Date of Patent: Apr. 27, 2004

(54) AIR TIGHT CANISTER WITH VACUUM RELIEF VALVE

(76) Inventor: Shin-Shuoh Lin, 27022 Falling Leaf Dr., Laguna Hills, CA (US) 92653

( * ) Notice: Subject to any disclaimer, the term of this patent is extended or adjusted under 35 U.S.C. 154(b) by 0 days.

(21) Appl. No.: 10/143,419

(22) Filed: May 13, 2002

(65) Prior Publication Data

US 2003/0209545 A1 Nov. 13, 2003

(51) Int. Cl.[7] ..... B65D 51/16

(52) U.S. Cl. ..... 220/203.11; 220/203.16; 220/231; 220/632; 220/367.1; 215/260; 215/262; 215/270

(58) Field of Search ..... 220/203.11, 203.13, 220/203.14, 203.16, 203.17, 203.18, 231, 360, 380, 632, 367.1; 215/260, 262, 270; 137/43, 589

(56) References Cited

U.S. PATENT DOCUMENTS

| | | | | | |
|---|---|---|---|---|---|
| 2,114,823 | A | * | 4/1938 | Toscano | 229/120 |
| 2,117,075 | A | * | 5/1938 | Belmont | 220/231 |
| 2,172,457 | A | * | 9/1939 | Schwartz | 220/578 |
| 2,173,571 | A | * | 9/1939 | Jesnig | 137/854 |
| 2,425,609 | A | * | 8/1947 | Fink | 220/364 |
| 3,401,850 | A | * | 9/1968 | Anderson | 222/482 |
| 3,578,467 | A | * | 5/1971 | Huber | 426/112 |
| 3,924,774 | A | * | 12/1975 | Donnelly | 220/580 |
| 4,561,558 | A | * | 12/1985 | Richman et al. | 220/203.29 |
| 4,754,888 | A | | 7/1988 | Letch et al. | |
| 5,249,703 | A | | 10/1993 | Karp | |
| D346,933 | S | | 5/1994 | Denny et al. | |
| 5,339,981 | A | * | 8/1994 | Kral | 220/580 |
| D362,156 | S | | 9/1995 | Goto et al. | |
| D362,369 | S | | 9/1995 | Bridges | |
| D373,051 | S | | 8/1996 | Kramer et al. | |
| D386,948 | S | | 12/1997 | Wissinger | |
| 5,727,707 | A | * | 3/1998 | Wickland et al. | 220/288 |
| D396,777 | S | | 8/1998 | Inoue | |
| D398,187 | S | | 9/1998 | Parker | |
| D411,713 | S | | 6/1999 | Bridges | |
| 5,918,761 | A | | 7/1999 | Wissinger | |
| 5,931,352 | A | * | 8/1999 | Dirr | 222/212 |
| D416,757 | S | | 11/1999 | Ginuntoli | |
| D425,758 | S | | 5/2000 | Freed | |
| 6,206,220 | B1 | * | 3/2001 | Stodd | 220/231 |
| 6,364,145 | B1 | * | 4/2002 | Shaw et al. | 220/203.11 |
| 6,520,369 | B1 | * | 2/2003 | Cytacki | 220/632 |
| 6,536,285 | B2 | * | 3/2003 | Watanabe et al. | 73/706 |
| 2002/0066732 | A1 | * | 6/2002 | Ogino | 220/203.04 |
| 2002/0160133 | A1 | * | 10/2002 | Jeter et al. | 428/35.7 |
| 2002/0166864 | A1 | * | 11/2002 | Stillinger et al. | 220/714 |

* cited by examiner

*Primary Examiner*—Stephen K. Cronln
*Assistant Examiner*—James Smalley
(74) *Attorney, Agent, or Firm*—Gordon K. Anderson

(57) ABSTRACT

A resilient vacuum relief valve 52 is urged tightly on the lid stem 44 engaging the lid bottom 42 while encircling the vent 46 preventing air passage through the vent 46. The vacuum relief valve 52 is also formed of a pliable, resilient thermoplastic such as silicon and is in an inverted hat shape or dish shape as shown in FIGS. 8 and 9 and includes a circumferential outwardly extending rim 54 on top that has sufficient resilience to deform when exposed to negative pressure. This arrangement provides an air tight seal when the lid 38 is inserted into the canister body 22 and while it remains stationary, however, when the lid 38 is pulled upwardly, negative pressure within the canister 20 is created, forcing the valve 52 to break its seal and relieve the newly created vacuum within the canister 20 allowing it to be easier to dislodge the lid 38 and preventing dispersal of powdered contents out of the canister 20 during lid removal.

13 Claims, 2 Drawing Sheets

AIR TIGHT CANISTER WITH VACUUM RELIEF VALVE

TECHNICAL FIELD

The present invention relates to a canister for storing dry powered goods in general. More specifically to a canister with a lid that incorporates a vacuum relief valve for relieving negative pressure within the canister when opening, precluding dispersing a portion of the uppermost contents away from the canister during lid removal.

BACKGROUND ART

Previously, many types of sealed lids have been used in endeavoring to provide an effective means to seal the contents within a storage vessel. In most cases a lid is used that contains a seal effectively sealing and securing the container, however, no provision has been included to prevent dispersing powdered contents away from the container during lid removal.

A search of the prior art did not disclose any patents that possess any of the novelty of the instant invention, however the following U.S. patents are considered related:

| Patent Number | Inventor | Issue Date |
|---|---|---|
| Des. 346,933 | Denny et al. | May 17, 1994 |
| Des. 362,156 | Goto et al. | Sep. 12, 1995 |
| Des. 362,369 | Bridges | Sep. 19, 1995 |
| Des. 373,051 | Kramer et al. | Aug. 27, 1996 |
| Des. 386,948 | Wissinger | Dec. 2, 1997 |
| Des. 396,777 | Inoue | Aug. 11, 1998 |
| Des. 398,187 | Parker | Sep. 15, 1998 |
| Des. 411,713 | Bridges | Jun. 29, 1999 |
| Des. 416,757 | Ginuntoli | Nov. 23, 1999 |
| Des. 425,758 | Freed | May 30, 2000 |
| 4,754,888 | Letsch et al. | Jul. 5, 1988 |
| 5,249,703 | Karp | Sep. 5, 1993 |
| 5,918,761 | Wissinger | Jul. 6, 1999 |

Letsch et al. in U.S. Pat. No. 4,754,888 discloses a carafe with an inner container surrounded by a casing. The inner container and the casing have an opening at the top which may be closed by a separate plug. The plug and opening in the container and casing are shaped such that it is possible to fill or empty the inner container while the plug is still in the opening. The plug and container both have mating grooves that provide opposed flow paths into and out of the container. The container also includes a basin around the top for receiving coffee from a coffee maker and the plug has openings to provide a flow path from the basin into the container interior.

Karp in U.S. Pat. No. 5,249,703 teaches a travel mug that includes a container and a lid in combination. The container has a handle and an annular lip that has an annulus capable of forming a seal with the top side of the annular lip. A cylindrical well in the lid has a vertical dividing wall such that the lid may be readily rotated by hand. The retaining arms extend from the underside of the lid and engage the underside of the annular lip to pull it into tight abutment. Diametrically opposed gaps in the lip act as passageway for the retaining arms. Similarly diametrically opposed notches in the lid align with the gaps to allow liquid to be poured from the container. A plug is used for closing the opening of the carafe that includes a lid with its lower rim serving as a seal against the bottom of the basin when it is screwed into the opening.

U.S. Pat. No. 5,918,761 issued to Wissinger is for an insulated container and cover combination that has an outer container shell terminating at an opening with a surrounding edge. An inner container shell is nested within the outer container shell and has an opening surrounded by a continuous edges in abutment with the surrounding edge. The inner container shell is spaced inwardly and is out of contact with the outer shell. A cover mounting assembly is attached to the outer shell adjacent to the opening. A single seal, made of elastomeric material, has a sealing surface disposed at the interface of the shells. Locating rings define the removable cover mounting assembly and locate the single sealing ring on the inner and outer shells.

For background purposes and as indicative of the art to which the invention is related reference may be made to the remaining cited design patents.

DISCLOSURE OF THE INVENTION

There are a myriad of different types of jars, containers, jugs, bottles, cans, and canisters used for storing various articles such as foodstuffs and the like. In order to provide some semblance of protection, most storage containers have some type of lid for closure and for protection of the contents from exposure to the environment. Particularly relevant to food, the container must be sealed, preferably incorporating an air tight seal which is the most desirable for prolonging the useful life of the contents. In order to secure the container sufficiently a seal is normally used which, if long term storage is required, may be a permanent lid that must be opened by piercing the top and removing the material such as in a metal can. Further bottles and jars are sealed by the use of a threaded lid with a resilient seal between the lid and the body that is compressed when installed.

Canisters have a different problem in that the material inside must be sealed to prevent atmospheric contamination but must be readily available to be used without special tools or prolonged twisting of lids or the like. Some canisters use compression latches and hinges to provide a tight seal and still have relatively easy access to the contents. Others like ceramic jar canisters simply use a compressible seal that is held in place by the weight of the lid itself The optimum type of closure is a simple resilient gasket that compresses very tightly when inserted into the canister creating a completely air tight seal. There is however a down side to this approach in that if the seal is sufficient to completely block out any air it also creates negative pressure when it is removed which can be detrimental if a powered food stuff is stored inside such as flour, confectioners sugar, baking powder, corn starch and the like. The result is that if the container is full and the lid is removed the vacuum created within draws some of the powered substance along with the lid and spreads it out away from the canister and onto the surrounding area making an unnecessary mess that must be cleaned up and any contaminated material disposed of It is therefore a primary object of the invention to add a vacuum relief valve to the lid to alleviate the negative pressure when removing the lid. As the lid is pulled upward the interior area of the canister is increased creating the vacuum which can pull the contents up at the same time, however, with the relief valve in place the valve outer fringes collapse and the negative pressure is released through the vents eliminating the problem entirely.

A secondary problem is also expunged in that as the vacuum created in the removal of a lid, with a tight seal, makes this type of lid detaching difficult. The better the seal the harder it is to remove the lid and it is important to have a secure seal to make the canister air tight. It may be clearly seen that the invention solves an important task which is appreciated by the user particularly when a powered substance is stored inside that may be spilled if one has to pull hard and all of a sudden the lid comes off easily loosing control of the canister entirely.

Another object of the invention is the ease of manufacture as once the injection mold incorporates the stem and vents it is easy to manually push the valve in place by hand which takes little effort and yet grips securely. The valve adds little to the overall cost of manufacture and assembly.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
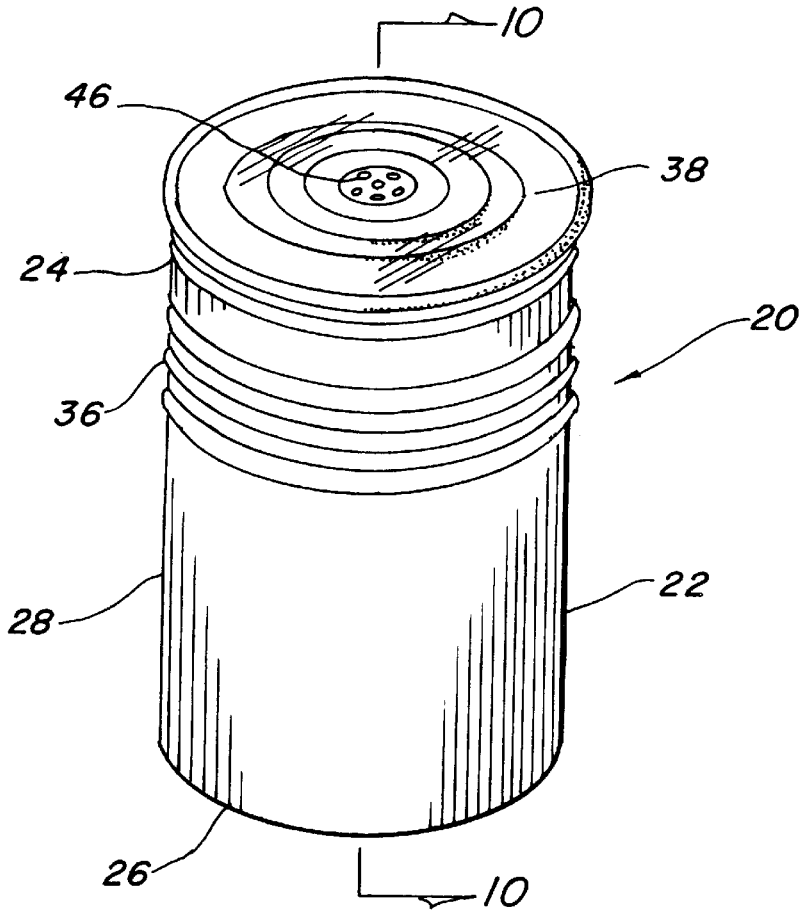
FIG. 1 is a partial isometric view of the preferred embodiment, in the form of an airtight canister with an integral vacuum relief valve.
Figure 2:
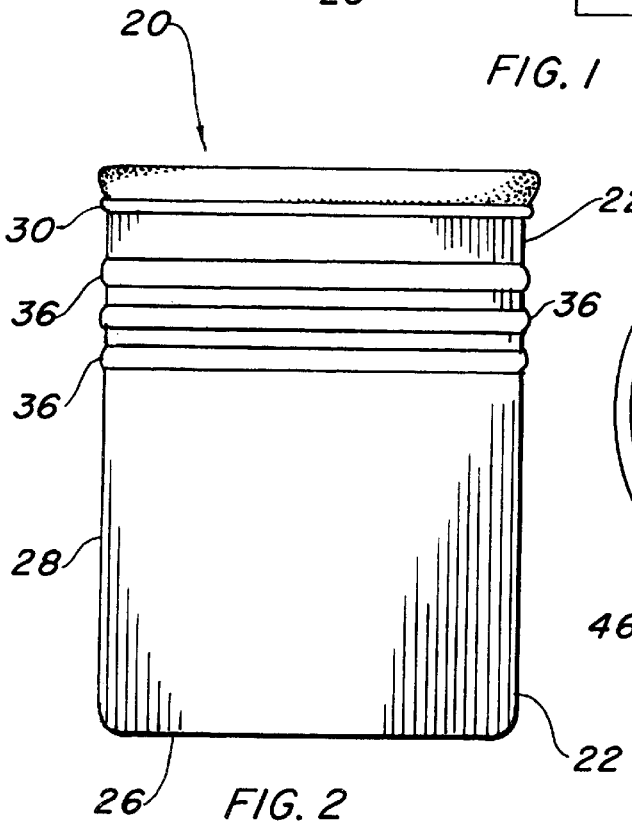
FIG. 2 is a front elevation view of the preferred embodiment. It will be noted, however, that the rear and side views are identical to this view as the invention is symmetrical in this plane.

The best mode for carrying out the invention is presented in terms of a preferred embodiment. This preferred embodiment is shown in FIGS. 1 thorough 11 and is comprised of a canister 20 that includes a body 22 preferably fabricated of metal such as stainless steel and formed into a cylinder with an open top 24, a closed bottom 26 and sides 28. It is also favored to incorporate a rolled seam 30 on the top edge in the stainless steel material. While stainless steel is preferred other materials may also be used in the fabrication of the body 22 such as plated steel or thermoplastic.

Figure 10:
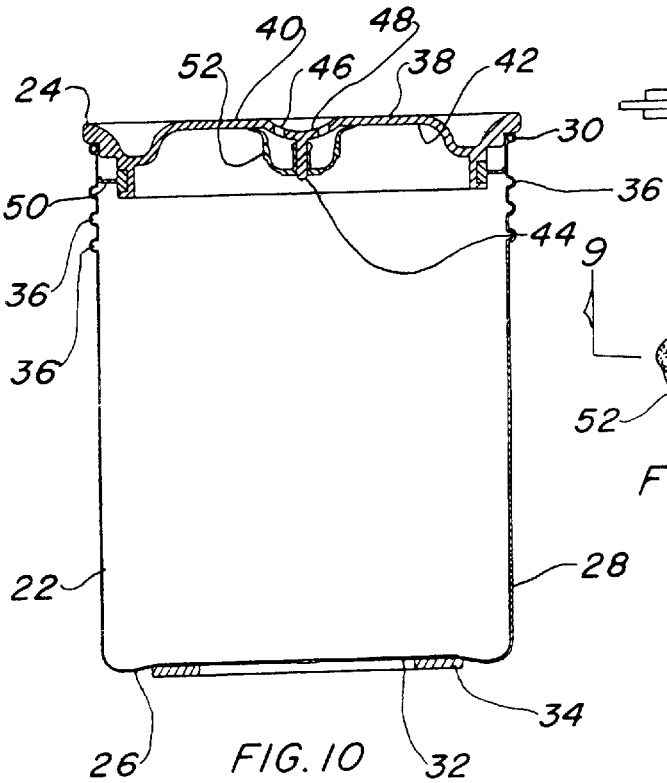
FIG. 10 is a cross sectional view taken along lines 10—10 of FIG. 1.

The bottom of the canister body 22 may incorporate a centrally located recess 32 as shown in FIG. 10 which permits a bottom cushion 34 to be added to facilitate positioning the canister on a flat surface, such as a table or counter top, in a secure and stable manner. The cushion 34 is a resilient sponge material such as closed cell neoprene or the like which is compressible, non-absorbent and slip proof The body 22, as shown in the drawings, may contain ribs 36 for decorative purposes, to add structural integrity within the sides 28 and also to assure the vessel is uniformly round.

The canister 20 includes lid 38 that interfaces with the canister body top 24 for closing the canister to protect goods stored inside. The lid 38, includes a lid top 40 and a lid bottom 42, with the lid bottom created with valve attaching means in the form of a downwardly depending stem 44. The lid 38 also includes at least one vent 46 adjacent to the stem 44. The vent or vents 46 extend completely through the lid top 40 and bottom 42 creating an air passageway therethrough.

The lid 38 is made of thermoplastic such as selected from a group consisting of acrylic, allyl diglycol carbonate, polycarbonate, polystyrene, polysulfone, polyester sulfone or polyester, and is preferably transparent. It is also possible to use any other material for the structure of the lid 38 however injection molding is the most cost effective and desirable.

Figure 3:
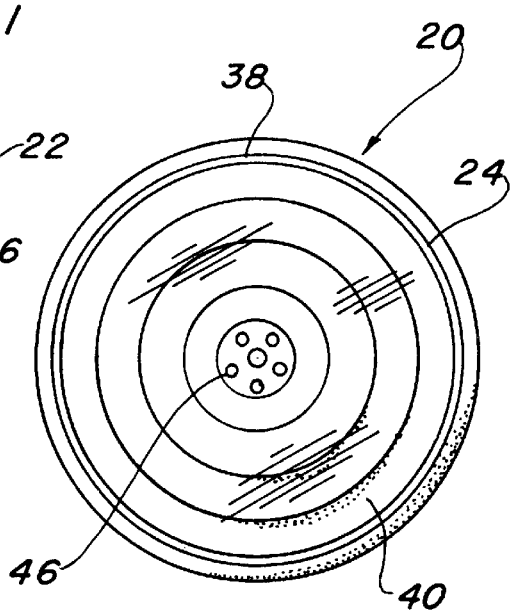
FIG. 3 is a top view of the preferred embodiment, with the lid attached.
Figure 4:
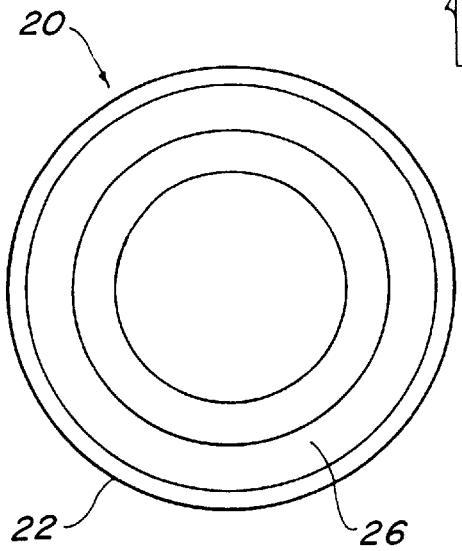
FIG. 4 is a bottom view of the preferred embodiment, with the lid attached.
Figure 5:
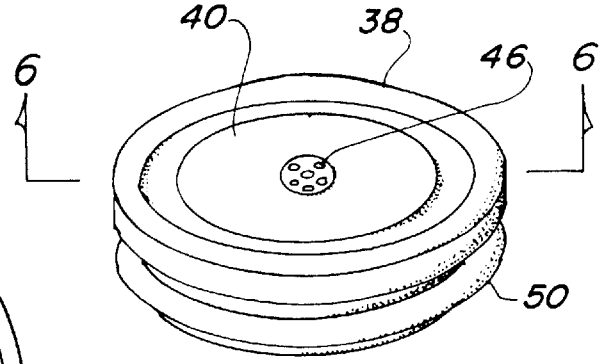
FIG. 5 is a partial isometric view of the lid completely removed from the invention for clarity.
Figure 6:
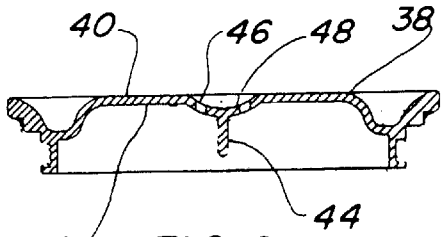
FIG. 6 is a cross sectional view taken along lines 6—6 of FIG. 5.

The stem 44, which is integrally formed in the bottom of the lid 38, is centrally located and has a similarly situated concave recess 48 upon which the stem 44 is positioned on the bottom portion thereof. This recess 48 is illustrated best in FIGS. 6 and 10 and forms a base for the stem 44. The number of vents 46 are preferably increased into a, so called, plurality of vents that are positioned to surround the stem 44, although only a single vent would suffice. The drawings depict five vents 46, as illustrated in FIG. 3, however their size and number are rather arbitrary as long as the orifice size will handle the airflow without undue restriction.

Figure 7:
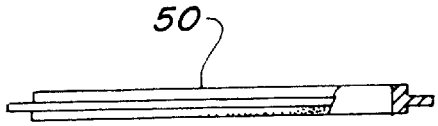
FIG. 7 is a side elevation view of the lid's lip seal completely removed from the invention for clarity and cut-away on one end to illustrate the cross sectional area.

A lip seal 50 disposed securely on the lid 38, intimately engaging an inside surface of the canister body 22 in a air tight manner when the lid 38 is inserted into the canister 20. The seal 50 is formed of pliable resilient thermoplastic, such as silicon, and has an inclined tee shape as illustrated in FIG. 7. The outside diameter of the seal 50 is larger than the inside diameter of the canister body 22 which causes the seal to bend and conform to the diametrical configuration of the body 22. The resilience of the material forms the seal and the differences in diameters along with the thickness of the seal 50 assures a tight leak proof junction.

Figure 8:
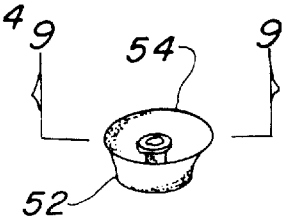
FIG. 8 is a partial isometric view of the vacuum relief valve completely removed from the invention for clarity.
Figure 9:
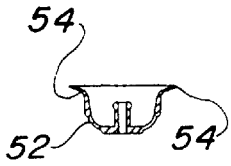
FIG. 9 is a cross sectional view taken along lines 9—9 of FIG. 8.
Figure 11:
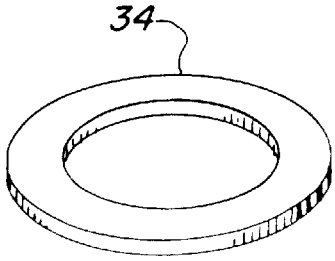
FIG. 11 is a partial isometric view of the canister bottom cushion completely removed from the invention for clarity.

A resilient vacuum relief valve 52 is urged tightly on the lid stem 44 engaging the lid bottom 42 while encircling the vent 46 preventing air passage through the vent 46. The vacuum relief valve 52 is also formed of a pliable, resilient thermoplastic such as silicon and is in a hat shape as shown in FIGS. 8 and 9 and includes a circumferential rim 54 that has sufficient resilience to deform when exposed to negative pressure. This arrangement provides an air tight seal when the lid 38 is inserted into the canister body 22 and while it remains stationary, however, when the lid 38 is pulled upwardly, negative pressure within the canister 20 is created, forcing the valve 52 to break its seal and relieve the newly created vacuum within the canister 20 allowing it to be easier to dislodge the lid 38 and preventing dispersal of powdered contents out of the canister 20 during lid removal While the invention has been described in complete detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

What is claimed is:

1. An air tight canister that incorporates an integral vacuum relief valve for storing various food stuffs including powdered goods, comprising, a canister body in cylindrical shape having sides, a top and a bottom, a lid, having a top and a bottom, interfacing with the top of the canister body for closing the canister to protect goods stored inside, said lid bottom having an integral downwardly depending stem and said lid having at least one vent, adjacent to the stem, extending completely through the lid, top to the lid bottom, creating an air passageway therethrough, a lip seal disposed securely on the lid, intimately engaging an inside surface of the canister body in a air tight manner when the lid is inserted into the canister, and a resilient self-acting vacuum relief valve formed of a pliable, resilient silicon thermoplastic in a non-planar shape having a circumferential outwardly extending rim on top with sufficient resilience in the rim to deform when exposed to negative pressure, wherein said vacuum relief valve urged tightly upon the lid stem engaging the lid bottom encircling the vent preventing air passage through the vent providing an air tight seal when the lid is inserted and stationary, however when the lid is drawn upwardly, negative pressure within the canister is created forcing the valve to break the seal and relieve the vacuum within the canister allowing the lid to be dislodged easier and to prevent dispersal of powdered contents out of the canister during lid removal making it relatively easy to remove the lid.

2. The air tight canister as recited in claim 1 wherein said canister body is formed of stainless steel.

3. The air tight canister as recited in claim 1 wherein said canister body further comprises a rolled seam top edge.

4. The air tight canister as recited in claim 1 wherein said canister body further comprises said bottom having a centrally located recess therein.

5. The air tight canister as recited in claim 4 wherein said bottom centrally located recess further contains a bottom cushion disposed within the recess to facilitate positioning on a flat surface in a secure and stable manner.

6. The air tight canister as recited in claim 1 wherein said lid is made of thermoplastic selected from the group consisting of acrylic, allyl diglycol carbonate, polycarbonate, polystyrene, polysulfone, polyester sulfone and polyester.

7. The air tight canister as recited in claim 6 wherein said thermoplastic lid is transparent.

8. The air tight canister as recited in claim 1 wherein said stem on the bottom of the lid is centrally located.

9. The air tight canister as recited in claim 1 further comprising, said lid having a centrally located concave recess upon which the stem is positioned on a bottom portion.

10. The air tight canister as recited in claim 1 wherein said at least one vent is a plurality of vents that surround the stem.

11. The air tight canister as recited in claim 1 wherein said lip seal is formed of a pliable, resilient silicon thermoplastic.

12. An air tight canister that incorporates an integral vacuum relief valve for storing various food stuffs including powdered goods, comprising, an enclosed canister body having sides, a top and a bottom, a lid, interfacing with the top of the canister body for closing the canister to protect goods stored inside, said lid having an integral stem and at least one vent, adjacent to the stem, creating an air passageway through said lid, a lip seal disposed around said lid, engaging an inside surface of the canister body in an air tight manner when the lid is inserted into the canister, and a resilient self-acting vacuum relief valve formed of a pliable, resilient silicon thermoplastic in a non-planar shape having a circumferential outwardly extending rim on top with sufficient resilience in the rim to deform when exnosed to negative pressure, wherein said vacuum relief valve disposed on the stem engaging the lid encircling the vent preventing air passage through the vent providing a seal when the lid is inserted, when the lid is opened negative pressure within the canister forces the valve to relieve the vacuum within the canister preventing dispersal of powdered contents from the canister during lid removal and making it relatively easy to remove the lid.

13. An air tight canister that incorporates an integral vacuum relief valve for storing various food stuffs including powdered goods, comprising, an enclosed canister body, a lid, interfacing with the body for closing the canister to protect goods stored inside, said lid having a valve attaching means and a vent, a lip seal on the lid, engaging the canister body in an air tight manner when the lid is inserted into the canister, and a resilient self-acting vacuum relief valve formed of a pliable, resilient silicon thermoplastic in a non-planar shape having a circumferential outwardly extending rim on top with sufficient resilience in the rim to deform when exposed to negative pressure, wherein said vacuum relief valve connected to the attaching means engaging the lid preventing air passage through the vent and providing a seal when the lid is inserted, when the lid is opened negative pressure within the canister forces the valve to relieve the vacuum within the canister preventing dispersal of powdered contents from the canister during lid removal and making it relatively easy to remove the lid.

* * * * *